United States Patent [19]

Quatkemeyer

[11] 4,203,592

[45] May 20, 1980

[54] HORSESHOE TYPE GAME DEVICE

[76] Inventor: Tony Quatkemeyer, 3190 Browning, Sarasota, Fla. 33577

[21] Appl. No.: 936,181

[22] Filed: Aug. 23, 1978

[51] Int. Cl.[2] ..... A63B 67/06

[52] U.S. Cl. ..... 273/336; 273/398

[58] Field of Search ..... 273/100, 98, 99, 104, 273/105 R, DIG. 13

[56] References Cited

U.S. PATENT DOCUMENTS

| | | | |
|---|---|---|---|
| 163,845 | 6/1875 | Browne | 273/100 |
| 1,089,872 | 3/1914 | Schultze | 416/98 |
| 1,513,968 | 11/1924 | Crandall | 273/100 |
| 1,705,501 | 3/1929 | Sas | 273/100 |
| 2,538,128 | 1/1951 | Simmons | 273/104 |
| 2,666,642 | 1/1954 | Ward | 273/100 |
| 3,119,619 | 1/1964 | Frank | 273/104 |
| 3,332,828 | 7/1967 | Faria et al. | 273/DIG. 13 |
| 3,540,730 | 11/1970 | Kerr | 273/104 X |
| 3,815,915 | 6/1974 | Chapman | 273/104 |
| 3,964,745 | 6/1976 | Ogg | 273/105 R X |

*Primary Examiner*—William H. Grieb

*Attorney, Agent, or Firm*—Clarence A. O'Brien; Harvey B. Jacobson

[57] ABSTRACT

A game in which annular disks or rings are pitched or tossed at targets provided on each of two similar game mats. Each game mat comprises a small piece of carpet-like material having a stake extending above it and disposed immediately behind a circular aperture of greater diameter than the annular disks or rings. The game mats are spaced by approximately 20 feet and the rings are tossed from behind one game mat toward the other game mat. Points are given according to the proximity of the ring to the aperture after the ring has landed. If a player is able to produce a "ringer" by having the ring land directly over the stake, he wins automatically. Otherwise, the first player to reach a given number of points in his point score is the winner.

4 Claims, 3 Drawing Figures

10
12
14
16
18
20
2
2

10
12
14
15
16
18
20

20
20
22
22

HORSESHOE TYPE GAME DEVICE

BACKGROUND OF THE INVENTION

1. Field of the Invention

This invention relates to a ring toss or horseshoe type pitch and toss game in which objects are pitched at a distance to a target area and points are scored in accordance with the relation of the object to the target area after the object has landed.

2. Description of the Prior Art

Games requiring skill in the tossing of an object toward a target are well-known in the art. One example of such a game in U.S. Pat. No. 3,540,730, issued to Kerr, on Nov. 17, 1970. Kerr discloses a target which is provided to afford a landing terminal for a simulated spacecraft game. The target comprises barriers, hazards and a landing. In order to reach the landing the object must pass barriers and hazards which are created by essentially upright posts. U.S. Pat. No. 2,666,642, issued to Ward, on Jan. 19, 1954, shows a ring toss type game in which an annular member is tossed at a substantially vertically disposed target in an effort to drop the annulus over the target in surrounding relationship thereto. A secondary target in the form of a cup is provided, in order that, failing to have the annulus surround the upright member, the player may gain points by having his annulus fall within the cup. U.S. Pat. No. 3,119,619, issued to Frank, on Jan. 28, 1964, discloses a ring game in which rings are tossed at an upright member having a lateral extension. Points are scored in accordance with the position the rings take when they come to rest upon the upright member and/or the lateral extension thereto. U.S. Pat. No. 1,098,872, to Akerberg, issued June 2, 1914, discloses a ring toss game wherein an improved surface surrounding an upright stake is provided in order to reduce bouncing and other extraneous movement of the rings. U.S. Pat. No. 1,705,501, to Sas, issued Mar. 19, 1929, shows a ring toss game where a ring is tossed at a target having a rotatable centrally suspended table having numbered posts combined with a combination of colors whereby some posts will be more difficult to see than others. Points are scored by ringing one of the posts with points allocated to the posts according to the color of the post. U.S. Pat. No. 2,538,128, to Simmons, issued Jan. 16, 1951, discloses a ring-toss type game board which has a series of upwardly extending pins and the object of the game being to ring the pins with a plurality of rings thrown by a player. A secondary target comprising a pocket located centrally of the pin configuration is provided where points may be scored according to the portion of the target encircled by the ring. A different score being achieved according to which pin is hit or by virtue of disposing the ring in the central pocket. U.S. Pat. No. 3,815,915, to Chapman, issued June 11, 1974, shows a game in which solid disks and hollow rings are pitched at the recessed holes and erect pins respectively. Each recessed hole and erect pin is marked with a score value.

SUMMARY OF THE INVENTION

An object of the present invention is to provide a game which is simple and easy to use and can be played indoors or outdoors equally well. The game uses a member in the form of a mat of carpet-like material with a hole disposed therein in order to both reduce any noise which may be made by a ring hitting the target and at the same time reduce any bouncing effect produced when the ring hits the target.

An additional object of the present invention is to produce a ring-toss game whereby team play is encouraged. The game can easily accommodate several players without having the game mat become over crowded with rings.

Another object of the present invention is to provide a ring-toss game in which the materials of the game may be neatly folded into a compact size for storage thereof. The rings of the present game are relatively small in size and the carpet of the game can be rolled up into a neat package with the target stakes inserted therein for storage of all the elements.

Yet a still further object of the present invention is to provide a game of the ring-toss type wherein the landing mat of the game may also be used to form a cup-like secondary target area. In this manner, additional components need not be added to the game for secondary targets and the cost of the game is thereby reduced.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Now with reference to the figures, the target areas of the present invention are generally designated by the numeral 10. Each of these targets 10 are identical in every respect and are laid on a playing field, in the form of a generally planar support surface, to form a mirror image of each other. Preferably the targets are placed at an extent of 20 feet from each other.

Figure 1:
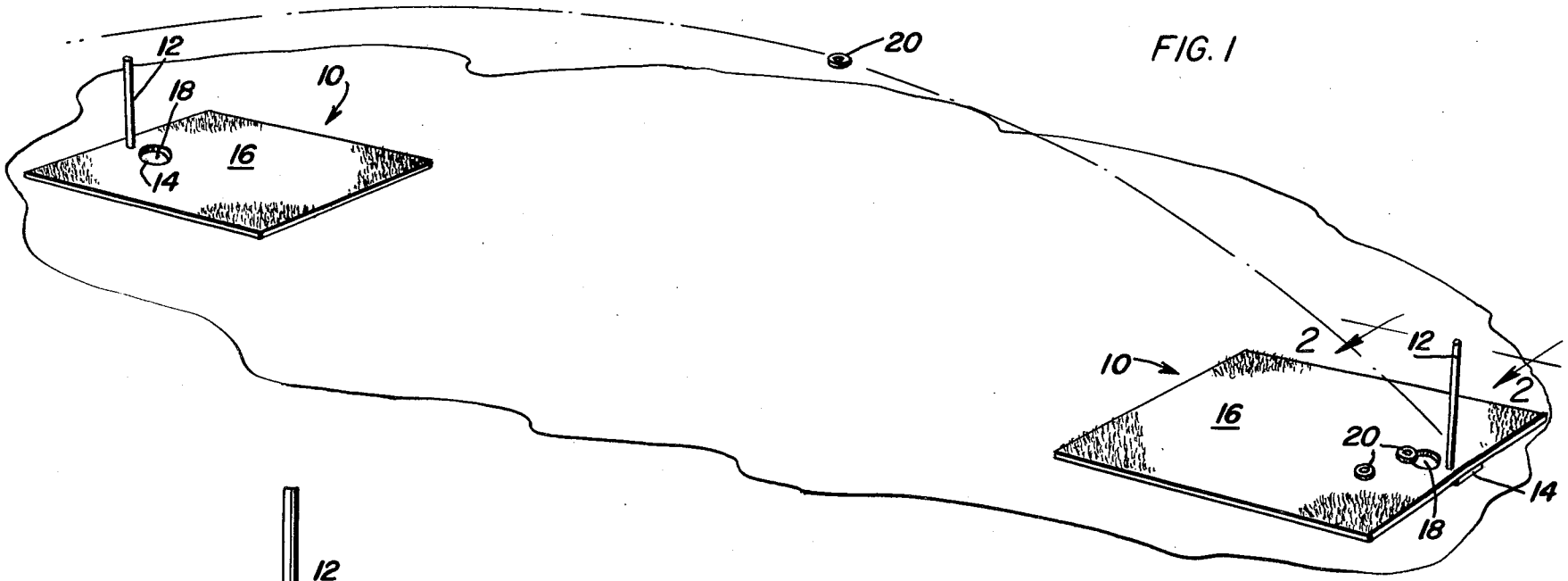
FIG. 1 is a perspective view of the mats of the invention as properly layed out on a playing field.
Figure 2:
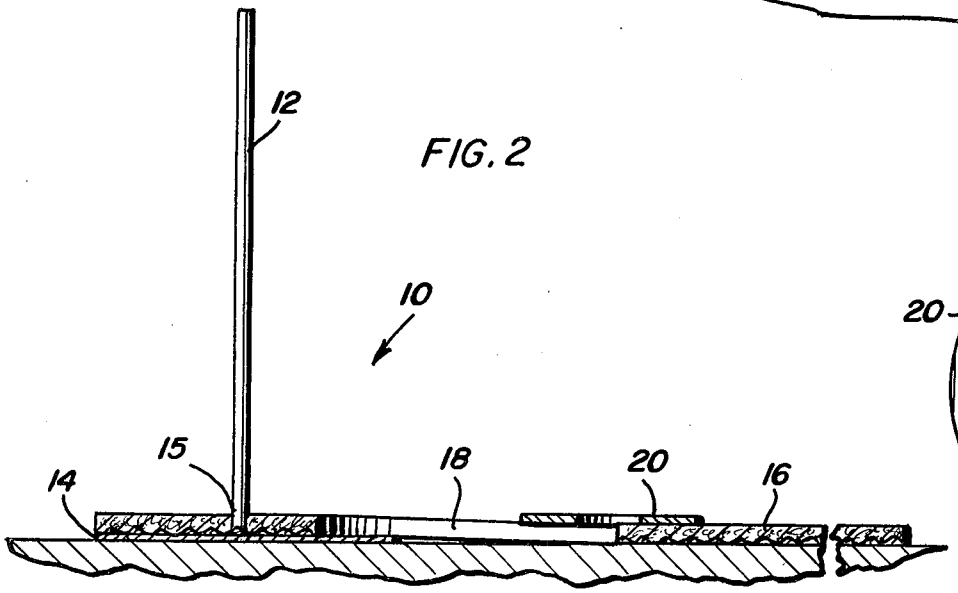
FIG. 2 is a sectional view, on an enlarged scale, as taken substantially along a plane passing through section line 2—2 of FIG. 1.

Each target consists of an upright stake or post 12 made of metal, wood, plastic or any other suitable material and firmly attached to a base plate 14 such as by welding as can clearly be seen in FIGS. 1 and 2. Upright stake 12 provides the primary target of the present game and extends from base plate 14 through a small hole 15 disposed in a flexible panel or mat in the form of carpet 16. As is clear from the figures, stake 12 is placed toward the rear of carpet 16 and in the lateral center thereof with the rear edge of plate 14 coinciding with the rear edge of carpet 16. The forward edge of plate 14 extends across the opening 18 with the plate 14 and stake 12 being stabilized by the mat 16. Preferably stake 12 is located two inches from the rear of carpet 16. Carpet 16 is preferably produced of 120 ounce artificial grass carpet with a width of 34 inches and a length of 44 inches. Stake 12 should extend to a height of approximately seven inches above carpet 16. Disposed directly forward of stake 12 and in alignment there with is an opening or aperture in carpet 16 designated by the numeral 18. This opening should be circular in shape with a diameter of approximately 4½ inches. This hole is located with the center thereof approximately 3¼ inches forward of stake 12. This hole constitutes the secondary target of the game and points are scored according to how rings are positioned with respect to the hole after they land on the carpet as will be explained hereinafter.

Figure 3:
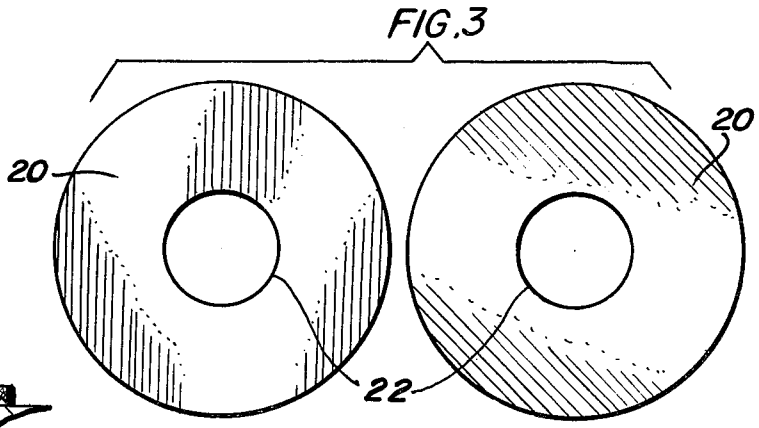
FIG. 3 is a plan view of the disk rings used in the game as in FIG. 1.

As shown in FIG. 3, a plurality of rings 20 are provided. These rings or annular disks may be in the form of metal washers or the like and have an over-all dimension of approximately 2¼ inches with a ¾ inch hole 22 disposed in the center thereof. When playing the game, at least four of these rings are required. Two rings are designated for each player or team of players with the rings being color coded in pairs to differentiate those of the various players. As will be noted, the over-all diameter of the ring is less than that of the aperture 18 in carpet 16 while the diameter of the hole in the ring is significantly greater than the diameter of stake 12 which is approximately 3/16th of an inch. Also, the width of each ring is less than the height of the carpet 16 with the height of the carpet 16 being significantly less than the over-all diameter of the rings.

In play with two participants, two washers are allocated to each player. The players approach one of the target areas and stand behind it. One at a time, the players pitch or toss both of the rings at the second target area located approximately 20 feet away. After each player has pitched his rings, all players go to the other end of the playing field, record their score and stand behind the second target area, throw the rings back onto the first target area. This play continues until one player scores a total of 21 points.

Additional players may be allowed to play. If four players are playing, the rings may be allocated with one to each player and the two players with the same color rings will form one team. Alternatively, additional rings may be used with these rings forming pairs which are color coded and each player may play for himself.

When the rings land on mat 16, points are allocated according to the relation of the ring 20 to hole 18. If any portion of ring 20 is within one diameter, that is 2¼ inches, from hole 18, one point is scored. If any portion of ring 20 overlaps the edge of hole 18 but does not touch the bottom of hole 18, three points are scored. This situation is demonstrated in FIG. 2 wherein it can be seen that ring 20 while overlapping hole 18 does not extend down to the bottom thereof. If the ring 20 falls within hole 18 or any portion of ring 20 is disposed within hole 18 so as to touch the bottom thereof, five points are scored. If a "ringer" is scored by having ring 20 fall over stake 12 with stake 12 extending through the center of the ring, the player thus scoring a "ringer" automatically wins and the game is over. Certain exceptions to these rules apply. If a ringer is scored by the first player, and the second player has a turn left and also scores a ringer, the first player's ringer is topped and the ringers cancel each other and the play may continue. In like manner, if one player's ring having landed with a portion thereof touching the bottom of hole 18 is topped by another player's ring, the score is again cancelled. Also, all rings thrown must land initially on mat 16 in order to be counted. Any ring that hits outside of the mat and thereafter bounces or rolls upon the mat is considered foul and does not count. The ring must hit on the mat and stay to be counted for score.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game device wherein annular disks are pitched at a target area comprising:

a pair of target areas each being formed only of resilient, artificial grass-like carpet material for absorbing the shock of landing disks and providing for compact storage thereof, each of said target areas disposed in a horizontal plane;

a pair of stakes, one of said stakes extending vertically from each of said target areas providing first targets which an annular disk may be tossed toward;

a depression disposed within each of said target areas providing second targets for an annular disk to be pitched toward;

a plurality of annular disks for pitching at said target areas; and further wherein said depression is circular in shape and has a diameter which is larger than the outside diameter of said annular disk so as to enable said disk to fit wholly within said depression, and the lateral dimensions of said stake are much less than the inside diameter of said annular disk and thus enabling said annular disk to fit easily over and surround said stake.

2. The device of claim 1 wherein said stakes and depressions associated with each target area are disposed in alignment with one another.

3. The device of claim 1 wherein each of said target areas is in the form of a flexible panel disposed on a generally planar support surface, a rigid plate underlying an edge portion of the panel and including an outer edge coinciding with a portion of the outer edge of the panel, said stake being rigid with the plate and extending up through the panel to a point substantially above the upper surface thereof, said depression being formed in the panel inwardly of and in alignment with the stake.

4. The device of claim 3 wherein said plate includes an inner edge extending across said hole with the plate and stake being stabilized by the panel.

* * * * *